US005191745A

United States Patent [19]

Story

[11] Patent Number: 5,191,745

[45] Date of Patent: Mar. 9, 1993

[54] MOUNTING SYSTEM FOR PRE-FABRICATED PANELS

[76] Inventor: Thomas J. Story, 146 Locust St., Tuckerton, N.J. 08087

[21] Appl. No.: 719,260

[22] Filed: Jun. 21, 1991

[51] Int. Cl.[5] ..... E04B 2/38

[52] U.S. Cl. ..... 52/589; 52/235; 52/127.8; 52/397; 52/506; 52/510

[58] Field of Search ..... 52/127.8, 235, 506, 52/510, DIG. 1, 589, 588, 397, 398, 399

[56] References Cited

U.S. PATENT DOCUMENTS 3,974,608 8/1976 Grearson ..... 52/235

*Primary Examiner*—David A. Scherbel

*Assistant Examiner*—Wynn E. Wood

*Attorney, Agent, or Firm*—Patrick J. Pinto

[57] ABSTRACT

A prefabricated building covering system having an arrangement of support members selectively arrayed on a building under-structure, said under-structure adapted for supporting the walls and roof of the building including a plurality of panel members, a first support member, a second support member, and intermediate support members. Said intermediate support members are used as and when needed. Said second support member and intermediate member having a leaf spring mounted there-on for allowing installation or removable of said panels as and when desired without disturbing adjacent panels.

16 Claims, 2 Drawing Sheets

MOUNTING SYSTEM FOR PRE-FABRICATED PANELS

BACKGROUND OF THE INVENTION

1. Field of the Invention

This invention is believed to be found in the field of static structures or buildings and more particularly in the field of an attachment system for prefabricated building panels.

2. Description of the Prior Art

The art of attaching pre-fabricated panels to the under-structure of a building is known. The known prior art systems employ a ship lap or a tongue and groove type of joint. These presently used joining systems require the sequential placement and fastening of the panels to the buildings under-structure.

These known prior art systems require that all phases of the building process be precisely timed to provide an economical building process. This building process involves the co-ordination of many trades. The use of a ship-lap or tongue and groove joint in the panel requires that each panel be attached to the building in a sequential order.

Not only does installation of the panels present a timing problem but removal of any one panel from a curtain wall most likely will require removal of several panels in addition to the panel to be removed.

It has therefore been determined that there is a need for a panel system which may be attached to the building structure which would allow independent installation or removal of each panel. This system should provide a curtain wall which protects the building under-structure from harmfull weather conditions and provides an envelope for the buildings contents.

SUMMARY OF THE INVENTION

This invention may be summarized, at least in part, with respect to its objects. It is an object of this invention to provide and it does provide a panel system which allows for the installation of substantially all individual panels independently of the next panel.

It is an object of this invention to provide and it does provide a panel mounting system which allows for the removal of substantially any and all panels independently of an adjacent panel.

It is an object of this invention to provide a panel mounting system which allows for the expansion and contraction of individual panels in two directions.

It is an object of this invention to provide and it does provide a panel attaching system which is economical and labor saving.

In addition to the above summary, the following disclosure is detailed to insure adequacy and aid in the understanding of this present invention. This disclosure, however, is not intended to cover each new and inventive concept, no matter how it may later be disguised by variation in form, additions, or by further improvements. For this reason, there has been chosen specific embodiments of an attaching system for pre-fabricated building panels. This system is particularly adapted for use in new and old construction.

These specific embodiments have been chosen for the purpose of illustration and description, as shown in the accompanying drawings wherein

BRIEF DESCRIPTION OF THE DRAWING

In the following description and in the claims, various details are identified by specific names for convenience. These names are intended to be generic in their application. The corresponding reference characters refer to like members throughout the several figures of the drawings.

The drawings accompanying, and forming a part of this specification disclose certain details of construction associated with the present invention. These details are only for the purpose of explanation, but structural details may be modified without departure from the principles of the present invention. It is anticipated that this invention may be incorporated into forms other than as shown.

DESCRIPTION OF THE PREFERRED EMBODIMENT

Figure 1:
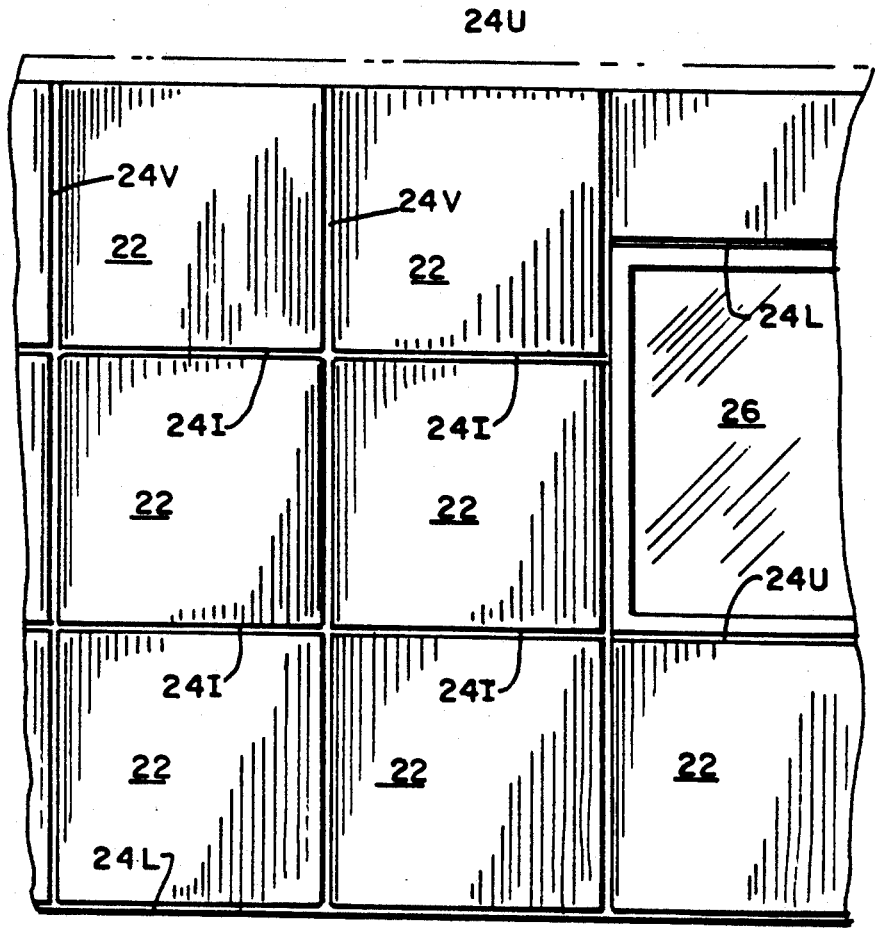
FIG. 1 represents a partial front elevational view, partly diagrammatic, of a curtain wall employing panels and support system of the present invention.
Figure 4:
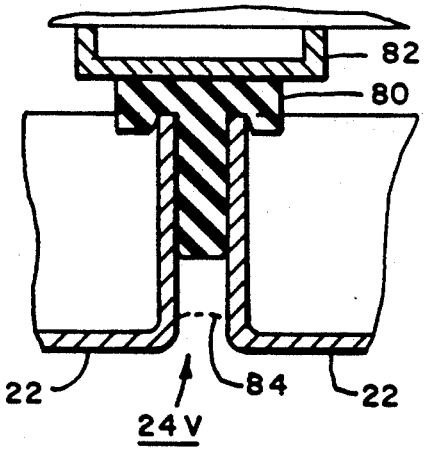
FIG. 4 represents a fragmentary sectional view of a joint between two panels, this view taken along line 4—4 of FIG. 1.

Referring to FIG. 1, a portion of a curtain wall 20 is shown. This curtain wall 20 includes a plurality of panel members 22. These panel members 22 have been shown as being rectangular and flat for convenience of this description. These panel members 22 may be flat or curved to suit a particular design. The panels 22 may also have shapes other than rectangular to suit a particular design. The panels 22 are preferably positioned with a predetermined space there-between to define a joint 24. The joint 24 may be further defined as being a lower joint 24L, an intermediate joint 24I, an upper joint 24U, and a substantially vertical joint 24V. Each of these joints may be more clearly seen in FIGS. 2 and 4.

Still referring to FIG. 1, the curtain wall 20 is shown having a window or louver panel 26. The support system of the present invention will allow panels such as windows louvers, doors and the like to be mounted by the support system or by their own mounting system. Typical jointing arrangements are shown adjacent the panel 26. It is anticipated that other combinations of joints may be employed for a specific application.

Figure 2:
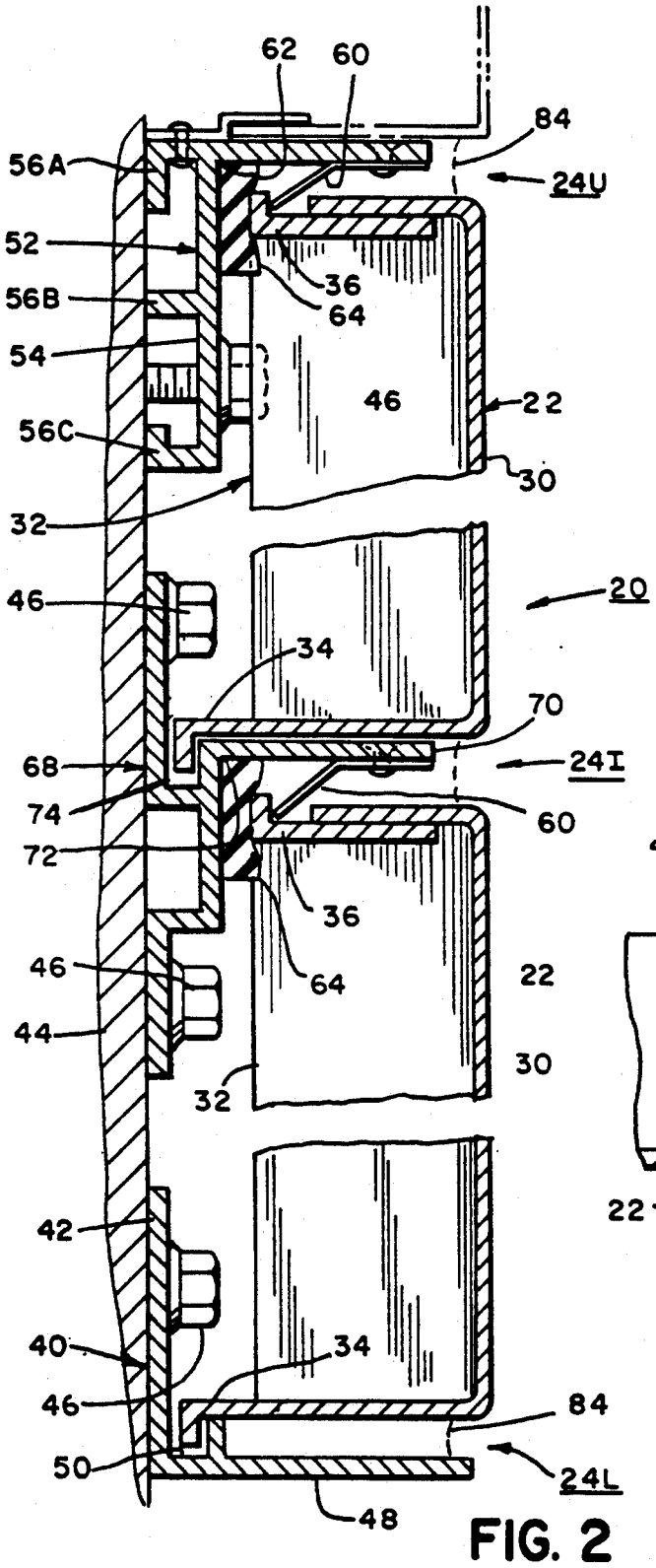
FIG. 2 represents a side elevational view, in section, of the present invention, this view taken along line 2—2 of FIG. 1.

Referring now to FIG. 2, each panel 22 has a predetermined thickness resulting in a exterior surface 30 and an interior surface or plane 32. Engaging means 34 and 36 are provided along the periphery of the panel 22. Preferably these engaging means are located at opposite sides to provide maximum retention of the panels 22. Each of the engaging means 34 and 36 may be an integral part of the panel as shown at 34 or as a separately attached part as shown at 36. Engaging means 34 and 36 may be characterized as outwardly extending flanges of a predetermined length and thickness. These engaging means may be substantially continuous or may be provided at spaced intervals.

Referring still to FIG. 2, the lower joint 24L comprises a first support member 40 which is disposed in a substantially continuous array. This first support member 40 preferably is formed with a substantially L-shaped profile. One leg member 42 of the first support member 40 is securely fastened to the under-structure 44 of the building, by and with a suitable means such as a threaded fastener 46. The other leg 48 of the first support member 40 extends outwardly from the under-structure 44. The first support member 40 has a substantially continuous channel 50 formed on the interior surface of its leg 48. Preferably this channel is formed at or near the interior corner formed by the first leg 42 and the other leg 48. This channel 50 is sized and shaped to receive the engaging mean 34 of the panel 22. It is to be noted that this channel may be located at any convenient point along the leg 48.

Still referring to FIG. 2, an upper joint 24U comprises a second support member 52 being disposed in a substantially continuous array. This second support member 52 is formed with a substantially L-shaped profile also. A first leg 54 is securely fastened to the under-structure 44 of the building by an appropriate means such as fastener 46. This second support member 52 is fastened to the under-structure in a selectively spaced alignment with the first support member 40. This selective spacing allows for the insertion of a panel substantially as shown. The first leg 54 is shown with rib members 56A; 56B; and 56C integrally formed there-on. These ribs 56 act as spacers and are used for installation convenience. It is anticipated that a standard shim may be used as a spacer under the first leg 54.

A second leg 58 of the second support member 52 extends outwardly from the under-structure 44 for a predetermined distance. A leaf spring 60 is securely fastened to the interior surface of the second leg 58 by a suitable means such as a rivet, screw, or the like. The free end of the leaf spring 60 is oriented to face the interior corner 62 of the second support member 52. Preferably a biasing means 64 such a rubber strip or urethane spring is attached to the second support member 52 at the interior corner 62. The space between the free end of the leaf spring 60 and the biasing means 64 is sufficient to allow the second engagement means 36 to be retentively held there-between. This second support member may be used along the coping line of a building by attaching a clip for providing a hidden retainer for the coping shown in dashed outline.

When it may be necessary to install at least one row of panels 22 above a bottom row of panels 22 an intermediate joint 24I is formed. This intermediate joint 24I comprises an intermediate support member 68 which is selectively disposed and positioned intermediate the first support member 40 and the second support member 52. This intermediate support member 68 is also securely attached to the under-structure of the building by means of a suitable means such as fastener 46. The position of the intermediate support is dictated by the size of the panel 22. This intermediate support 68 is formed in a more or less T-shape. The intermediate support 68 is securely attached to the under-structure 44 of the building by a suitable means such as a threaded fastener 46. The intermediate support 68 has its leg member 70 extending outwardly from the under-structure. A leaf spring 60 is selectively mounted to the leg 70 by a suitable means as discussed above. A biasing means 62 is provided at the interior corner 72 to aid in the retention of the panel 22.

An elongated groove 74 is formed in the intermediate support 68. This elongated grove 74 is selectively sized and shaped to receive and retain the engaging means 34 of the panel 22.

Figure 3:
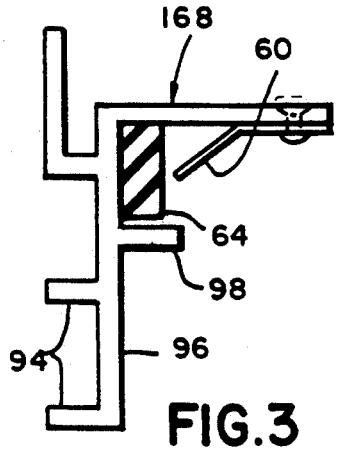
FIG. 3 represents and alternate embodiment of an intermediate support member of the present invention.

It is to be noted that the intermediate support may have profiles other that as shown in FIG. 2. It is quite possible to use a two piece intermediate support which is made from first support 40 and second support 52 or provide an alternate profile as shown in FIG. 3.

USE AND OPERATION

The type and quantity of support members 40; 52, and 68 is dependent on the number of rows of panels 22 to be installed. If the installation is only one panel high, a first support 40 and second support 52 are only required. The intermediate support 68 is used when more than a single row of panels is to be installed. Referring to FIG. 2, it can be seen that a panel can easily be installed in the lower position or the upper position. The installer places the engaging means 34 into either the channel 50 or the groove 74 and pushes the panel 22 into retentive engagement by the spring 60. The biasing means 62 is used to automatically adjust for manufacturing tolerances. After the panel 22 is retained by the leaf spring 60 a second panel 22 may be easily inserted above, below, or on either side of the installed panel. The installer may use a gauging means to provide a desired space to form joint 24V or he may use a substantially continuous T-shaped gasket 80 carried on a support bar 82, as may be seen in FIG. 4. This gasket 82 is carried substantially continuously between its associated support members 40 and 62; 62 and 62; or 62 and 52. After the panel 22 has been correctly positioned the installer would caulk the joints with a suitable sealant.

Removal of a panel is made possible by inserting a bar to deflect the leaf spring 60 from engagement with the engaging means 36; rotating the panel outward; then disengaging the engagement means 34 from the channel 50 of groove 74. If the caulking has been installed around the panel it is necessary to remove the caulking first.

It is anticipated that the present mounting system can successfully be used with various types of panels 22. The panels 22 may be of a substantially uniform cross-section, a laminated insulated panel, a window, a lover, vent. The present system is adaptable to receive and retain any of the various panels which may be part of the overall design of the structure.

Figure 5:
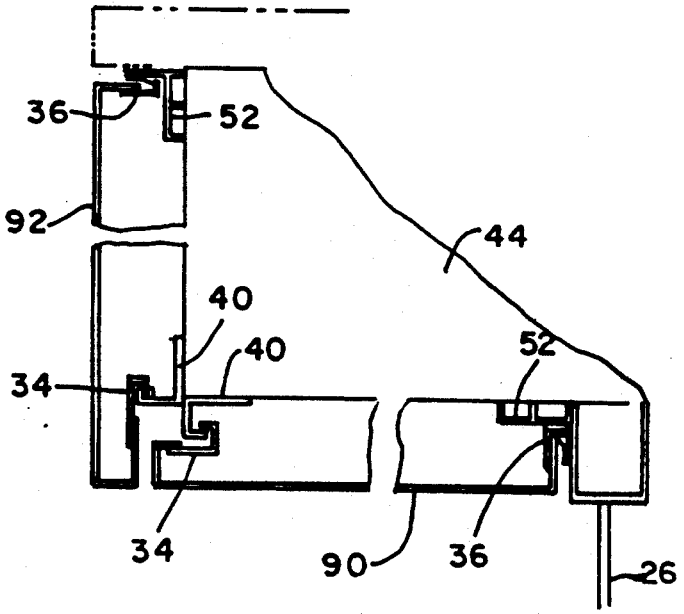
FIG. 5 represents a fragmentary sectional view, in a reduced scale, of the application of the present system to a soffit area.

Referring to FIG. 5, there is shown an example of the present mounting system being used in connection with a soffit of a building. In this particular arrangement, the engaging means extends from the interior plane 32 of the soffit panel 90. In this particular instance the engaging means 34 is supported by a modified first support 40, It is anticipated that a special soffit support may be formed if the quantity was sufficient to justify the manufacture, The soffit panel 90 also has a engaging means 36 opposite said engaging means 34. This engaging means 36 would be retained by another support member such as the second support 52. It is to be noted that the support members may be modified to fit a particular installation by cutting, notching, or bending. The fascia 92 may be covered with a panel having similar construction as panel 90. It can clearly be seen that the present system is versatile in its use and may be adapted to many conditions which exist at and on a building.

Referring to FIG. 3, an alternate embodiment of an intermediate support is shown. This alternate intermediate support member, generally identified as 168, includes a plurality of rib members 94 extending from its attaching leg 96; and a safety lug 98. The safety lug 98 provides a means for preventing the engaging means 36 of the panel member 22 from moving away from engagement from the leaf spring 60. This safety lug may also be provided on the second support member 52 as well as intermediate support member 68. This safety lug 96 provides a quick indication means to ascertain that the proper spacing has been maintained between support members, by not allowing the engaging means 36 to be engaged by the leaf spring 60.

The support members 40; 52; 68; and 168 are presently anticipated as being manufactured from a metal material, such as an aluminum extrusion, but other suitable materials may be used such as Steel, Reinforced Plastics or the like.

The present system has been shown in the drawings as having the various support members as being fastened to the under-structure in a substantially horizontal alignment. It is anticipated that the present system may be employed by fastening the various support members in positions other than horizontal.

Terms such as "left", "right", "up", "down", "bottom", "top", "front", "back", "in", "out", and the like are applicable to the embodiments shown and described in conjunction with the drawings. These terms are merely for the purpose of description and do not necessarily apply to the position in which the panel mounting system the present invention may be utilized.

While these particular embodiments of an improved panel mounting system have been shown and described, it is to be understood that the invention is not limited thereto and protection is sought to the broadest extent the prior art allows.

What is claimed is:

1. A prefabricated building covering system having an arrangement of support members selectively arrayed on a buildings under-structure, said under-structure adapted for supporting the walls and roof of the building, said pre-fabricated system comprising:

(a) a plurality of panel members, each of said panel members having a predetermined thickness and shape, each of said panel members having an external surface, and internal surface, and at least two selectively positioned engaging means along its peripheral sides;

(b) a first of said support members being disposed in a substantially continuous array on said under-structure, said first of said support members being substantially L-shaped and having a substantially continuous channel formed in and on an interior portion of one leg member, said channel being selectively sized and shaped to receive one of said engaging means of each of said panel member;

(c) a second of said support members being substantially continuously disposed on said under-structure, said second support member being fastened in a selectively spaced and parallel relationship with said first support member, said second support member being substantially L-shaped, said second support member having at least one leaf spring member selectively positioned on an interior surface of its extending leg member and said leaf spring having its free end facing an interior corner of said second support member; and (d) wherein one of said engagement means of said panel member is retained in and by said channel in said first support member and a second of said engagement means of said panel member is removably retained by said leaf spring attached to said second support member and each retained panel member adapted for being individualy removed from said under-structure and said support members absent disturbing any adjacent panel member.

2. A prefabricated building covering system as recited in claim 1 further comprising:

at least one intermediate support member disposed on said under-structure, said intermediate support member having a substantially T-shape, said intermediate support member having an elongated groove selectively formed thereon, and at least one of said leaf springs being selectively positioned on an interior surface of an extending leg member of said intermediate support member and said leaf spring having its free end facing an interior corner of said intermediate support member; and wherein each of said intermediate support members is selectively positioned and disposed on said under-structure intermediate said first support member and said second support member for mounting one of said panel members above a lowest of said panel members, said lowest of said panel members having one of its engagement means being retained by said channel of said first support and a second engagement means of said lowest of said panel members being removable retained by said leaf spring of said intermediate support member, and one of said engagement means of each of said panel member above said lowest panel member being retained in and by said elongated groove of said intermediate panel and said second of said engagement means of said panel member above is removably retained by said leaf spring attached to its associated support member and each of said retained panel members adapted for being individually removed from said under-structure and said support members absent disturbing any adjacent panel member.

3. A prefabricated building covering system as recited in claim 1 wherein said second support member includes a biasing means adapted for urging said retained engagement means against said free end of said leaf spring.

4. A prefabricated building covering system as recited in claim 2 wherein said second support member and said intermediate support member further includes a biasing means adapted to urging said retained engaging means against said free end of said leaf spring.

5. A prefabricated building covering system as recited in claim 1 wherein said engaging means of each panel member is a flange member extending outwardly from one of said peripheral sides of said panel.

6. A prefabricated building covering system as recited in claim 1 wherein at least one of said engaging means of each panel member is a substantially continuous extended member along at least one of said peripheral sides.

7. A prefabricated building covering system as recited in claim 1 wherein a plurality of said engaging means of said panel member are spaced at selected intervals along at least one peripheral side of said panel member.

8. A prefabricated building panel system as recited in claim 1 wherein said leaf spring is substantially continuous and being adapted for retaining said panel member at any point along said second support member.

9. A prefabricated building panel system as recited in claim 2 wherein said leaf spring is substantially continuous and being adapted for retention of said panel member at any position along said second support member and said intermediate member.

10. A prefabricated building covering system as recited in claim 2 wherein said first support member, said second support member, and said intermediate support member are made of an extruded material.

11. A prefabricated building covering system as recited in claim 10 wherein said extruded material is aluminum.

12. A prefabricated building covering system as recited in claim 1 which includes a T-shaped gasket member adapted for providing a preferred spacing between adjacent panel members and along said peripheral sides not being retained by one of said support members.

13. A prefabricated building covering system as recited in claim 1 wherein said first support member and said second support member are disposed in a substantially horizontal array.

14. A prefabricated building covering system as recited in claim 2 wherein said first support member, said second support member, and intermediate support members are disposed in a substantially horizontal array.

15. A prefabricated building covering system as recited in claim 1 wherein said second support member further includes a safety lug member, said safety lug member being selectively positioned relative to said extending leg member of said second support member, said safety lug member adapted for providing a selected retained position of said second of said engagement means by said leaf spring.

16. A prefabricated building covering system as recited in claim 2 wherein each of said second support member and said intermediate support member includes a safety lug member, said safety lug member selectively positioned relative to its associated extending leg member, said safety lug member adapted for providing a selected retained position of said second of said engagement means by said leaf spring.

* * * * *